United States Patent [19]

Schwartz et al.

[11] Patent Number: 4,493,780

[45] **Date of Patent: * Jan. 15, 1985**

[54] WATER-BASED HYDRAULIC FLUIDS HAVING IMPROVED LUBRICITY AND CORROSION INHIBITING PROPERTIES

[75] Inventors: Ellen S. Schwartz, Warren, Mich.; Cline A. Tincher, Homewood, Ill.

[73] Assignee: BASF Wyandotte Corporation, Wyandotte, Mich.

[ * ] Notice: The portion of the term of this patent subsequent to Jun. 28, 2000 has been disclaimed.

[21] Appl. No.: 496,467

[22] Filed: May 20, 1983

Related U.S. Application Data

[63] Continuation-in-part of Ser. No. 249,200, Mar. 30, 1981, Pat. No. 4,390,439.

[51] Int. Cl.[3] ..... C09K 3/00; C10M 3/04

[52] U.S. Cl. ..... 252/73; 252/32.5; 252/49.3; 252/49.5; 252/51.5 A; 252/74; 252/75; 252/76; 252/77; 252/78.5; 252/79

[58] Field of Search ..... 252/73, 74, 75, 76, 252/77, 79, 49.3, 32.5, 51.5 A, 152 R, 78.5, 49.5

[56] References Cited

U.S. PATENT DOCUMENTS

| | | | |
|---|---|---|---|
| Re. 30,142 | 11/1979 | LeSuer | 252/78.5 X |
| 4,138,346 | 2/1979 | Nassry et al. | 252/49.5 X |
| 4,310,436 | 1/1982 | Camp | 252/78.5 X |
| 4,342,658 | 8/1982 | Tincher et al. | 252/32.5 |
| 4,390,439 | 6/1983 | Schwartz et al. | 252/76 X |
| 4,391,722 | 7/1983 | Schwartz et al. | 252/76 X |

FOREIGN PATENT DOCUMENTS

| | | | |
|---|---|---|---|
| 61823 | 10/1982 | European Pat. Off. | 252/78.5 |
| 61693 | 10/1982 | European Pat. Off. | |
| 66842 | 12/1982 | European Pat. Off. | 252/76 |

*Primary Examiner*—John E. Kittle
*Assistant Examiner*—Mukund J. Shah
*Attorney, Agent, or Firm*—David L. Hedden; Joseph D. Michaels

[57] ABSTRACT

In accordance with the instant invention, a water-based hydraulic fluid, having improved anti-wear and corrosion inhibition properties can be obtained by blending neodecanoic acid with a conventional water-based hydraulic fluid composition.

14 Claims, No Drawings

WATER-BASED HYDRAULIC FLUIDS HAVING IMPROVED LUBRICITY AND CORROSION INHIBITING PROPERTIES

This application is a continuation-in-part of copending patent application, Ser. No. 249,200, filed Mar. 30, 1981, now U.S. Pat. No. 4,390,439.

BACKGROUND OF THE INVENTION

1. Field of the Invention

This invention relates to water-based hydraulic fluids characterized by improved lubricity, anti-wear and corrosion inhibition properties.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil-based hydraulic fluids can be further enhanced by the use of said additives.

Over the past 25 years, various substitutes for petroleum oil-based hydraulic fluids have been developed in order to overcome one of the major deficiencies of petroleum oils, namely, flammability. Recent interest in the use of hydraulic fluids having up to 99 percent or more of water has resulted from the higher cost of petroleum oils and recent emphasis on problems of ecologically suitable disposal of contaminated or spent petroleum oil-based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids, when used as hydraulic fluids, are not generally suitable for use in ordinary industrial equipment designed specifically for use with the petroleum oil-based hydraulic fluids since such fluids do not adequately prevent wear damage in pumps and valves of such equipment. However, such fluids have found application in specially designed, high cost, large size equipment which, because of said large size and thus inflexibility, is not suitable for use in most industrial plants. The soluble oil hydraulic fluid usage has thus been quite limited; usage has been largely confined to large installations where flexibility and size are not critical, such as in steel mills.

Many prior art fluids, such as the petroleum oil type, are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for hydraulic fluids characterized by reduced flammability.

It is also known to use, in equipment designed for use with mineral oil-based hydraulic fluids, flame-resistant glycol-water-based hydraulic fluids such as are disclosed in U.S. Pat. No. 2,947,699.

Hydraulic fluid compositions having water as a base are disclosed in U.S. Pat. Nos. 4,151,099 and 4,138,346. These patents disclose fluids comprising (1) a sulfur containing compound and (2) a phosphate ester salt. The U.S. Pat. No. 4,151,099 also includes a water-soluble polyoxyethylated ester of an aliphatic acid and a monohydric or polyhydric aliphatic alcohol, either one or both said acid and said alcohol being polyoxyethylated.

U.S. Pat. No. 2,349,044 discloses the use of carboxylic acids in corrosion protective compositions for applications such as lubricating oils, gasoline, diesel fuels, keorsene, etc. Preferred acids have at least 12 and preferably 20 or more carbon atoms.

U.S. Pat. No. 4,130,493 discloses a machining fluid which may be an aqueous machining fluid which incorporates aliphatic acids having carboxy groups. The organic acid is produced by a fermentation process which involves cultivating a micro-organism.

SUMMARY OF THE INVENTION

It has been discovered in accordance with the instant invention that the addition of small but effective amounts of neodecanoic acid to otherwise conventional water-based hydraulic fluids results in improved antiwear and corrosion inhibiting properties.

DESCRIPTION OF THE PREFERRED EMBODIMENTS

In accordance with the instant invention, a water-based hydraulic fluid, having improved anti-wear and corrosion inhibition properties can be obtained by blending neodecanoic acid with a conventional water-based hydraulic fluid composition.

While decanoic, also known as capric, acid has been well known in the art for years, the neoacids, which are synthetic highly-branched organic acids, are relatively new. The "neo" structure is generally considered to be as follows:

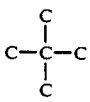

Commercially produced neodecanoic acid is composed of a number of $C_{10}$ isomers characterized by the presence of the above structure but in varying locations along the chain. It is generally a liquid with a low freezing point, i.e., less than −40° C., whereas decanoic (capric) acid is a solid melting at 31.4° C. Neodecanoic acid is synthesized starting with an olefin of mixed nonenes (at equilibrium) yielding a $C_{10}$ neoacid containing many isomers. This very highly branched and multi-isomer acid combination yields a liquid $C_{10}$ neoacid with a typical hydrocarbon-type odor. A typical structure and isomer distribution for neodecanoic acid is set forth below.

Typical Isomer Distribution for Neodecanoic Acid

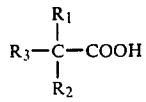

| Alkyl Group | % |
|---|---|
| $R_1$ and $R_2$ and methyl | 31 |
| $R_1$ = methyl; $R_2$ > methyl | 67 |
| $R_1$ and $R_2$ > methyl | 2 |
| $R_3$ always > methyl | |

This product is described in the article entitled "Neoacids: Synthetic Highly Branched Organic Acids," *Journal of American Oil Chemists Society,* Vol. 55, No. 4, pp. 342A to 345A (1978).

The neodecanoic acid described above may be employed with any conventional hydraulic fluid incorporating any or all of the following prior art components. For example, the hydraulic fluid may contain, as disclosed in U.S. Pat. Nos. 4,151,099 and 4,138,346, a phosphate ester, a sulfur compound, and a water-soluble polyoxyethylated aliphatic ester or ether. Optionally, the fluids of the invention can include an alkyldialkanolamide, additional corrosion inhibitor, a defoamer and a metal deactivator (chelating agent) as well as other conventional additives, such as dyes in normal amounts.

In accordance with this invention, it has been discovered that compositions useful as hydraulic fluids can be prepared having desirable antiwear and corrosion inhibiting properties. Generally, concentrates of the hydraulic fluids of the invention are shipped to the point of use where they are diluted with tap water. The compositions of the invention provide improved results over prior art fluids even when diluted with hard water.

Water-soluble esters of ethoxylated aliphatic acids and/or water soluble ethers of ethoxylated alcohols may be incorporated in the hydraulic fluid as additional anti-wear lubricant components. Preferred water-soluble ethers or esters are those of the ethoxylated $C_8$–$C_{36}$ aliphatic monohydric or polyhdyric alcohols or aliphatic acids, and aliphatic dimer acids. Suitable esters of ethoxylated aliphatic acids or alcohols are disclosed in U.S. Pat. No. 4,151,099 particularly beginning in column 3 thereof which is hereby incorporated by reference.

Representative water-soluble polyoxyethylated esters having about 5 to about 20 moles of oxide per mole are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

Conventional sulfur compound additives may also be incorporated in the hydraulic fluid such as the ammonia, amine or metal salts of 2-mercaptobenzothiazole or 5-, 6- and 7-substituted 2-mercaptobenzothiazole, said salts being formed on neutralization of the free acid form of 2-mercaptobenzothiazole with a base. Such sulfur compounds are disclosed particularly beginning in column 5 of U.S. Pat. No. 4,138,346 which is hereby incorporated by reference.

The sulfur-containing compound may also be sulfurized oxymolybdenum and oxyantimony compounds represented by:

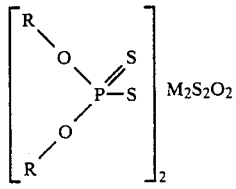

wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are sulfurized oxymolybdenum or oxyantimony organo-phosphorodithioate where the organic portion is alkyl, aryl or alkylaryl and wherein said alkyl has a chain length of 3 to 20 carbon atoms.

The compositions of the invention may also contain a phosphate ester selected from the group consisting of

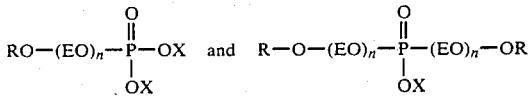

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X preferably is selected from the group consisting of hydrogen, alkali or alkaline earth metal, the residue of ammonia or an amine and mixtures thereof, and n is a number from 1 to 50. Metals such as lithium, sodium, potassium, rubidium, cesium, calcium, strontium, and barium are examples of the alkali or alkaline earth metal.

The free acid form of the phosphate ester is preferably utilized in preparing hydraulic fluids in accordance with compositions of the invention. These are more fully disclosed in U.S. Pat. No. 3,004,056 and U.S. Pat. No. 3,004,057, incorporated herein by reference. The free acid form may be converted to the salt form in situ in the preparation of the hydraulic fluids of the invention. Alternatively, the phosphate ester salts can be used directly.

The hydraulic fluid compositions of the invention may also contain an alkyldialkanolamide of the formula

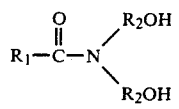

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl dicarboxylic acid and removing water of esterification. Useful alkyl dicarboxylic acids include branched or straight chain saturated or unsaturated aliphatic monocarboxylic or dicarboxylic acids as described below. Preferably, the saturated straight chain acids are used and the preferred amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid of the invention are resistance to precipitation in the presence of hard water, that is, in the presence of large amounts of calcium and magnesium ions in the water utilized to prepare the hydraulic fluid of the invention. In addition, the alkyldialkanolamides contribute to the antiwear and extreme pressure performance of the composition as well as to the metal corrosion resistance which is desirable in such fluids. The alkyldialkanolamides in aqueous solution are completely stable under neutral and alkaline conditions and show little tendency to hydrolyze or decompose on storage.

The hydraulic fluids and metalworking compositions of the invention generally consist of about 60 percent to about 99 percent water and about 40 percent to about 1 percent of additives. A high water hydraulic fluid will generally contain 90 percent or more of water. These additives can consist of concentrates comprising neodecanoic acid, possibly in combination with the water-soluble esters of ethoxylated aliphatic acid and/or ethoxylated alcohol ethers and/or sulfur containing compound; and/or phosphate ester, and/or alkyldialkanolamide and, in addition, can contain defoamers, thickeners, additional corrosion inhibitors and metal deactivators or chelating agents. Preferably, said fluids consist of about 75 percent to 99 percent water and about 25 percent to about 1 percent concentrate. The fluids are easily formulated at room temperature using tap water. Distilled or deionized water can also be used.

The amount of neodecanoic acid in the concentrate is preferably from about 3.0 to 20.0 percent by weight of the concentrate.

The amount of sulfur-containing compound in the hydraulic fluid concentrate of the invention is generally about 0 to 10 percent by weight and when employed is at a minimum of 1.0 percent. The concentration of the phosphate ester in the hydraulic fluic concentrate of the invention is generally about 1.0 to 20.0 percent by weight of the concentrate. The concentration of the water-soluble ester of the ethoxylated aliphatic acid and/or ethoxylated alcohol ether in the hydraulic fluid concentrate of the invention is generally about 1.0 percent to about 7.0 percent by weight. Preferably, the proportion by weight of each of these components is 1.0 to 5.0 percent.

The percent by weight alkyldialkanolamide in the concentrate is about 1 to 7, preferably about 1 to 5 based upon the total weight of the concentrate. Most preferably, equal amounts of the ester of an ethoxylated aliphatic alcohol and the alkyldialkanolamide are used.

The thickeners, metal deactivators and additional corrosion inhibitors which can be added either to the concentrate or to the hydraulic fluid or metalworking compositions of the invention are as follows:

The thickener can be of the polyglycol type. Such thickeners are well known in the art and this type of thickener is the preferred thickener. The polyglycol thickeners are well known in the art and are polyoxyalkylene polyols, having a molecular weight of about 2,000 to 40,000, prepared by reacting an alkylene oxide with a linear or branched chain polyhydric alcohol. Suitable polyols are prepared from ethylene oxide and propylene oxide in a mole ratio of between about 100:0 to about 70:30 ethylene oxide:propylene oxide. Such thickeners are commercially available and sold under the trademark "Ucon 75H-90,000" by Union Carbide and Carbon Chemical Corporation. The specifications for this commercial material call for a pour point of 40° F., a flash point of 485° F., a specific gravity at 20° C. of approximately 1:1 and a viscosity of about 90,000 S.U.S. at a temperature of 100° F. These thickeners are generally employed in an amount of about 15 to 20 percent by weight of the hydraulic fluid.

Preferred polyether polyol thickeners utilized to thicken the hydraulic fluids of the invention can be obtained by modifying a conventional polyether polyol thickening agent such as described above with an alpha olefin epoxide having about 12 to 18 carbon atoms or mixtures thereof. The conventional polyether polyol thickening agent can be an ethylene oxide homopolymer or a heteric or block copolymer of ethylene oxide and at least one lower alkylene oxide having 3 to 4 carbon atoms. Said ethylene oxide is used in the proportion of at least about 10 percent by weight based upon the total weight of the polyether polyol. Generally, about 70 to 99 percent by weight ethylene oxide is utilized with about 30 to 1 percent by weight of lower alkylene oxide having 3 to 4 carbon atoms.

Polyether polyols are generally prepared utilizing an active hydrogen-containing compound having 1,2,3 or more active hydrogens in the presence of an acid or basic oxyalkylation catalyst and an inert organic solvent at elevated temperatures in the range of about 50° C. to 150° C. under an inert gas pressure generally from about 20 to about 100 pounds per square inch gauge. Polyether polyols suitable as thickeners can be prepared by further reacting a polyether polyol as described above having a molecular weight of about 1000 to about 75,000, preferably 1000 to about 40,000 with said alpha-olefin epoxide so as to provide an alpha-olefin epoxide cap on the polyether polyol. The amount of alpha-olefin epoxide required to obtain the modified polyether polyol thickening agents of the invention is about 1 to about 20 percent by weight based upon the total weight of the modified polyether polyol thickeners. Alternatively, the modified polyether polyol thickening agents can be obtained by the heteric copolymerization of a mixture of ethylene oxide and at least one other lower alkylene oxide having 3 to 4 carbon atoms. An alpha olefin epoxide having about 12 to 24 carbon atoms or mixtures thereof is then polymerized on to the lower epoxide base. Small amounts of lower molecular weight epoxides may then be added beyond the higher epoxide. Further details of the preparations of the alpha-olefin epoxide modified polyether polyol thickening agents useful in the preparation of the hydraulic fluids of the invention can be obtained from applications Ser. No. 086,837 filed on Oct. 22, 1979, now U.S. Pat. No. 4,288,639, and Ser. No. 086,840 filed Oct. 22, 1979, now abandoned, both incorporated herein by reference.

Alternatively to the use of the above-described alpha-olefin oxides to modify high molecular weight polyether polyols, it is possible to substitute glycidyl ethers which can be prepared by reaction of an alcohol having 12 to about 18 carbon atoms with epichlorohydrin in accordance with the teachings of U.S. Pat. No. 4,086,279 and references cited therein, all incorporated by reference.

Other types of thickeners or viscosity increasing agents can be used in the hydraulic fluid and metal-working compositions of the invention such as polyvinyl alcohol, polymerization products of acrylic acid and methacrylic acid, polyvinyl pyrrolidone polyvinyl ether maleic anhydride copolymer and sorbitol. These materials are well known in the art and are utilized in varying proportions depending upon the desired viscosity and the efficiency of the thickening or viscosity increasing effect.

Generally about 10 to 60 percent of thickener in the concentrate will provide the desired viscosity in the final hydraulic fluid. By the use of such thickening agents, it is believed that the hydraulic fluids of the invention can be used in hydraulic pumps and other equipment because use of such thickeners substantially prevents internal and external leakage in the mechanical parts of the hydraulic system during the pumping of such hydraulic fluids.

Liquid-vapor corrosion inhibitors may be employed and can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine-type corrosion inhibitors are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N-dimethyl ethanolamine, triethanolamine, diethanolamine, monoethanolamine, 2-methyl pyridine, 4-methyl pyridine, piperazine, dimethyl morpholine, $\alpha$- and $\gamma$-picoline, isopropylaminoethanol and 2-amino-2-methylpropanol. These amines also function to neutralize the free acid form of the phosphate ester converting it to the salt form.

Imidazolines can be used for their known corrosion inhibiting properties with respect to cast iron and steel. Useful imidazolines are heterocyclic nitrogen compounds having the formula:

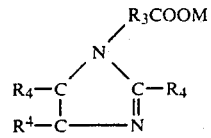

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

It is also contemplated to add other known corrosion inhibitors. Besides the amines, alkali metal nitrates, benzoates and nitrates listed above, the alkoxylated fatty acids are useful as corrosion inhibitors.

The above additional corrosion inhibitors are employed in the hydraulic fluid concentrates in total amount of about 2 to 40.0 percent by weight, preferably about 5 to 15 percent by weight. More specifically, it is preferred to employ benzoates or benzoic acid in amount of about 1 to 5 percent, amines in amount of about 2 to 40.0 percent, and imidazolines in amount of about 2 to 10 percent all by weight of the total amount of concentrate.

Metal deactivators may be used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium-2-mercaptobenzothiazole, and N,N'-disalicylidene-1,2-propanediamine. The proportion of metal deactivator to water in the hydraulic fluid concentrates of the invention is generally about 1 to 20 percent by weight and preferably about 3 to 5 percent by weight.

Conventional defoamers such as the well known organic surfactant defoamers, for example nonionic defoamers such as the polyoxyalkylene type nonionic surfactants, may also be employed in normal amounts. Preferred amounts are about 0.5 to 5.0 percent by weight of the total amount of concentrate. The concentrate may contain other conventional hydraulic fluid additives and possibly some impurities in normal minimal amounts.

The phosphate esters and esters of ethoxylated aliphatic acids and alcohols are water-soluble in the sense that no special method is required to disperse these materials in water and keep them in suspension over long periods of time. As a means of reducing corrosion, the pH of the water in the fluids of the invention is maintained above 7.0, preferably 7.0 to about 11.0, and most preferably 9 to about 10.5. Preferably, pH of the fluid concentrates is adjusted with an alkali metal or alkaline earth metal hydroxide, or carbonate, ammonia or an amine. Where these are employed, benzoic acid may be employed in lieu of alkali metal benzoates. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e., sodium dodecylbenzene sulfonate; polyoxyethylated fatty alcohol or fatty acid and polyoxyethylated alkyl phenol.

The concentrates of the hydraulic fluids of this invention can be made up completely free of water or contain any desired amount of water but preferably contain up to 85 percent by weight of water to increase fluidity and provide ease of blending at the point of use. As pointed out above, these concentrates are typically diluted with water in the proportion of 1:99 to 40:60 to make up the final hydraulic fluid.

The preferred final hydraulic fluid of the invention contains 0.3 to 5 percent by weight of neodecanoic acid and optionally may include by weight one or more of the following:

about 0.01 to 3.0 percent water soluble ester of exothylated aliphatic acid and/or ethoxylated alcohol ether, about 0.01 to 2.0 percent sulfur-containing compound, about 1.0 to 20.0 percent thickener, about 0.01 to 3.0 percent ethoxylated phosphate ester, or salt thereof, about 0.01 to 3 percent alkyldialkanolamide, about 0.05 to 10 percent additional corrosion inhibitors and most preferably about 0.01 to 2 percent benzoic acid and/or benzoates, about 0.02 to 2 percent amine type corrosion inhibitors and about 0.02 to 2 percent ethoxylated imidazoline, about 0.02 to 5 percent metal deactivators, about 0.01 to 2 percent defoamers plus other conventional additives such as dyes and impurities in normal amounts. For a high water fluid the total amount of additives should not exceed 5 percent.

The following examples more fully describe the hydraulic fluids of the invention and show the unexpected results obtained by their use. In the following examples of the invention, the wear properties of the hydraulic fluids were tested utilizing the Shell four-ball test method which is a standard test method for lubricants. No improvement was seen in lubricity, as measured by the test, from the addition of neodecanoic acid. However, the following examples clearly demonstrate improved corrosion inhibition and antiwear properties in a vane pump test as result of addition of neodecanoic acid.

The degree of corrosion inhibition of the additive was determined by a rust test using cast iron chips and steel plates measuring 3 inches by 8 inches. More specifically, 10 grams of cast iron chips are placed in a small mixing dish, 10 milliliters of the sample are added, and they are stirred for one minute. The excess liquid is then decanted with the dish held in a pouring position for 15 seconds. A short piece (approximately $\frac{3}{8}$ inches long) of radiator hose $1\frac{1}{2}$ inches ID is placed on the steel plate and the iron chips are poured into the piece of hose spreading as evenly as possible. The piece of hose is then removed and the chips are allowed to stand on the plate for 24 hours. The chips are then removed and the amount of rust left on the plate is measured using a scale of 0 to 100 percent of the area covered.

The Vane Pump Test procedure used herein employs apparatus similar to that of ASTM D2882. This comprises charging the system with 5 gallons of the test fluid and pumping at a rate of 8 gpm at temperatures ranging from 100° to 135° F. at 750 to 1000 psi pump discharge pressure (load) for 15 or more hours. Wear data were obtained by weighing the cam-ring and the vanes of the "pump cartridge" before and after the test.

Thickener #1 is a heteric copolymer of ethylene oxide, and 1,2-propylene oxide using trimethylol propane as an initiator and containing 75 percent oxyethylene units, and 25 percent oxypropylene units. This basic heteric copolymer is further reacted with a mixture of alpha olefin epoxides having 15 to 18 carbon atoms sold under the trademark VIKOLOX 15–18 by the Viking Chemical Company. The total molecular weight is about 7,000.

Thickener #2 is a heteric copolymer of ethylene oxide and 1,2-propylene oxide using trimethylol propane as an initiator and containing 80 percent oxyethylene units, and 20 percent oxypropylene units. This basic heteric copolymer is further reacted with a mixture of alpha olefin epoxides having 15 to 18 carbon atoms sold under the trademark VIKOLOX 15–18 by the Viking Chemical Company. The total molecular weight is about 7,000.

Thickener #3 is an ethylene oxide polymer which is reacted with a mixture of alpha olefin epoxides having 15 to 18 carbon atoms sold under the trademark VIKOLOX 15–18 by the Viking Chemical Company. The total molecular weight is about 7,000, Thickener #4 is a heteric copolymer of ethylene oxide and 1,2-propylene oxide using trimethylol propane as an initiator and containing 95 percent oxyethylene units, and 5 percent oxypropylene units. The basic heteric copolymer is further reacted with a mixture of alpha olefin epoxides having 15 to 18 carbon atoms sold under the trademark VIKOLOX 15–18 by the Viking Chemical Company. The total molecular weight is about 10,000.

Thickener #5 is a heteric copolymer of ethylene oxide and 1,2-propylene oxide using trimethylol propane as an initiator and containing 85 percent oxyethylene units, and 15 percent oxypropylene units. This basic heteric copolymer is further reacted with a mixture of alpha olefin epoxides having 15 to 18 carbon atoms sold under the trademark VIKOLOX 15–18 by the Viking Chemical Company. The total molecular weight is about 15,000.

The polyoxyalkylene defoamer is the polyoxyethylene adduct of a polyoxypropylene hydrophobic base, said hydrophobic base having a molecular weight of about 1750 wherein the oxypropylene content is about 90 weight percent of the molecule. This product is readily available on the market under the trademark Pluronic ®L-61.

QUADROL ® polyol is N,N,N'N',tetrakis (2-hydroxypropyl) ethylene diamine and has the following structural formula:

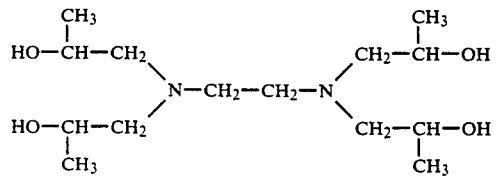

The ethoxylated phosphate ester utilized in the examples is reputed to be produced by the reaction of one mole of phosphorus pentoxide with a condensation product of one mole of nonylphenol and approximately 4 moles of ethylene oxide in accordance with the methods disclosed in U.S. Pat. Nos. 3,004,056 and 3,004,057.

The example are intended for the purpose of illustration. Throughout the application, all parts, proportions, and percentages are by weight and all temperatures are in degrees centigrade unless otherwise noted.

EXAMPLE 1

A hydraulic fluid concentrate, indicated herein as concentrate A, was prepared by blending 84.0 parts by weight of water, 1.5 parts by weight of ethoxylated phosphate ester, 1.5 parts by weight of a $C_{21}$ diethoxylated diacid mixed with a $C_{21}$ diethanol diamide, 5 parts by weight of 2-amino-2-methyl-1-propanol (95 percent aqueous solution), 3.0 parts by weight of a 50 percent by weight aqueous solution of tolyltriazole, 3 parts by weight of a 95 percent 2-heptyl-1-(ethoxypropionic acid) imidazoline, sodium salt in 5 percent of ethanol and 2 parts by weight of polyoxyalkylene defoamer.

From Concentrate A, the following fluids were prepared:

| | Weight % | |
|---|---|---|
| Fluid No. | 1 | 2 |
| Concentrate A | 5 | 5 |
| Benzoic Acid | 2 | — |
| Neodecanoic Acid | — | 2 |
| Water | 93 | 93 |
| pH | 10.5 | 10.5 |

The percent rust on a steel panel was determined as set forth above with the following results:

| Fluid No. | | |
|---|---|---|
| % Rust on steel panel | 50 | 20 |

The percent of rust on a steel panel decreased in the solution containing 2.0 percent neodecanoic acid.

EXAMPLE 2

A hydraulic fluid concentrate, indicated herein as concentrate B, was prepared by blending 78.5 parts by weight of water, 3 parts by weight of ethoxylated phosphate ester, 3 parts by weight of a $C_{21}$ diethoxylated diacid mixed with a $C_{21}$ diethanol diamide, 5 parts by weight of 2-amino-2-methyl-1-propanol (95 percent aqueous solution), 4.5 parts by weight of a 50 percent by weight aqueous solution of tolyltriazole, 4 parts by weight of a 95 percent 2-heptyl-1-(ethoxypropionic acid) imidazoline, sodium salt in 5 percent of ethanol, and 2 parts by weight of polyoxyalkylene defoamer.

From Concentrate B, the following fluids were prepared:

| | Weight % | |
|---|---|---|
| Fluid No. | 3 | 4 |
| Concentrate B | 5 | 5 |
| Benzoic Acid | 2 | — |
| Neodecanoic Acid | — | 2 |
| pH | 10.5 | 10.5 |
| Water | 93 | 93 |

The percent rust on a steel panel was determined as set forth above with the following results:

| Fluid No. | 3 | 4 |
|---|---|---|
| % Rust on steel panel | 20 | 5 |

EXAMPLE 3

From Fluid #3 of Example 2 the following fluids were prepared:

| | Weight % | |
|---|---|---|
| Fluid No. | 5 | 6 |
| Fluid #3 | 5 | 5 |
| Polyoxyalkylene Thickener #1 | 7 | 7 |
| QUADROL | 1 | 1 |
| Tolyltriazole | 1 | 1 |
| Neodecanoic acid | 0 | 1 |
| pH adjusted to 9.6 with NaOH | | |
| Water | Balance | Balance |

The vane pump tests were performed as set forth above with the following results:

| Fluid | 5 | 6 |
|---|---|---|
| Duration of pump test, hours | 137 | 144 |
| Wear rate, mg/hour | 83.2 | 44.3 |

EXAMPLE 4

Seven complete hydaulic fluid compositions with and without neodecanoic acid were prepared having the compositions set forth below and subjected to the vane pump tests, the results of which are also set forth below.

| | Weight % | | | | | | |
|---|---|---|---|---|---|---|---|
| Fluid No. | 7 | 8 | 9 | 10 | 11 | 12 | 13 |
| Ethoxylated Phosphate Ester | 0.15 | 0.15 | 0.15 | 0.15 | 0.21 | 0.15 | 0.15 |
| $C_{21}$ Diethoxylated Diacid mixed with $C_{21}$ Diethanoldiamide | 0.15 | 0.15 | 0.15 | 0.15 | 0.21 | 0.15 | 0.15 |
| Polyoxyalkylene Defoamer | 0.10 | 0.10 | 0.15 | 0.10 | 0.14 | 0.10 | 0.10 |
| Tolytriazole (50% aqueous solution) | 1.225 | 0.225 | 1.225 | 1.225 | 1.715 | 0.225 | 0.225 |
| 2-amino-2-methylpropanol (95% aqueous solution) | 0.25 | 0.25 | 0.25 | 0.25 | 0.35 | 0.25 | 0.25 |
| 2-heptyl-1-(ethoxypropionic acid) imidazoline (95% in ethanol) | 0.2 | 0.2 | 0.2 | 0.2 | 0.28 | 0.2 | 0.2 |
| Benzoic Acid | 0.1 | 0.1 | 0.1 | 0.1 | 0.14 | 0.1 | 0.1 |
| NaOH as needed to adjust pH between 9.6 and 10 | + | + | + | + | + | + | + |
| Propylene Glycol | 10 | — | — | 5 | 5 | — | — |
| QUADROL | — | — | 1.0 | — | — | — | — |
| Neodecanoic Acid | | | | 1.0 | 1.4 | 0.5 | 0.5 |
| Thickener 1 | | | | | | 6.5 | |
| 2 | 8 | 8 | 8.7 | | | | |

-continued

| Fluid No. | Weight % 7 | 8 | 9 | 10 | 11 | 12 | 13 |
|---|---|---|---|---|---|---|---|
| 3 | | | | | | 4.3 | |
| 4 | | | | | | | 3.0 |
| 5 | | | | | | | 3.1 |
| Wear Rate, mg/hr. (Vane Pump Test described above) | 46 | 89 | 86 | 44 | 25 | 33 | 26 |

While this invention has been described with reference to certain specific embodiments, it will be recognized by those skilled in the art that many variations are possible without departing from the scope and spirit of the invention.

The embodiments of the invention in which an exclusive privilege or property is claimed are defined as follows:

1. A hydraulic fluid concentrate characterized by improved anti-wear and corrosion inhibiting properties comprising water, neodecanoic acid in the amount of about 0.3 to 20.0 percent by weight of said concentrate, a polyether thickener having a molecular weight of about 1000 to about 75,000 prepared by reacting ethylene oxide or ethylene oxide and at least one lower alkylene oxide having 3 to 4 carbon atoms with at least one active hydrogen-containing polyhydric alcohol initiator and at least one glycidyl ether having a carbon chain length of about 12 to about 18 aliphatic carbon atoms and wherein said glycidyl ether is present in the amount of about 1 to about 20 percent by weight based upon the total weight of said polyether thickener, and conventional hydraulic fluid additives.

2. The concentrate of claim 1 wherein said concentrate includes at least one additive selected from the group consisting of phosphate esters or salts thereof selected from the group consisting of

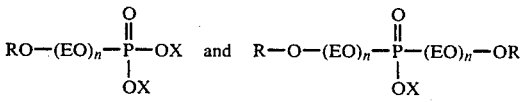

and mixtures thereof wherein ethylene oxide groups are represented by EO; R is selected from the group consisting of linear or branched chain alkyl groups wherein said alkyl groups have about 6 to 30 carbon atoms or alkylaryl groups wherein the alkyl groups have about 6 to 30 carbon atoms and X is selected from the group consisting of hydrogen, alkali or alkaline earth metal, the residue of ammonia or an amine and mixtures thereof, and n is a number from 1 to 50;

an alkyldialkanolamine of the formula

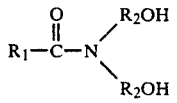

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

an additional corrosion inhibitor;

water-soluble ethers or esters of ethoxylated $C_8$–$C_{36}$ aliphatic monohydric or polyhydric alcohols or acids;

sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

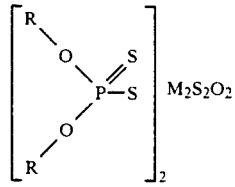

wherein M is molybdenum or antimony and R is organic and is selected from the group consisting of $C_3$–$C_{20}$ alkyl, aryl, alkylaryl radicals and mixtures thereof.

3. The concentrate of claim 2 wherein the amount of said additives is by weight about 1 to 20.0 percent phosphate ester, about 1 to 7 percent alkyl dialkanolamide, about 1.0 to 20.0 percent metal deactivator, about 0.5 to 5 percent defoamer, about 2 to 25 percent additional corrosion inhibitor, abut 1 to 7 percent of said water-soluble ethers or esters; about 0 to 10 percent of said sulfur compound, and about 10 to 60 percent thickener.

4. The concentrate of claim 2 wherein said additional corrosion inhibitors include nitrates; nitrites; benzoates; amines, and imidazolines having the formula:

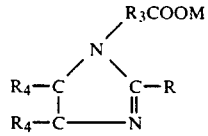

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

5. The concentrate of claim 4 wherein the amount by weight of said phosphate ester is about 1 to 20.0 percent, said alkyl dialkanolamide is about 1 to 7 percent, said metal deactivator is about 1 to 20.0 percent, said defoamer is about 0.5 to 5 percent, said imidazoline is about 2 to 10 percent, said benzoate is about 1 to 5 percent, said amine is about 2 to 10 percent, said water-soluble ether or ester is about 1 to 7 percent, said sulfur containing compound is about 1 to 10 percent, and said thickener is about 10 to 60 percent.

6. A hydraulic fluid characterized by improved anti-wear and corrosion inhibition properties comprising water, neodecanoic acid and a polyether thickener having a molecular weight of about 1000 to about 75,000 prepared by reacting ethylene oxide or ethylene oxide and at least one lower alkylene oxide having 3 to 4 carbon atoms with at least one active hydrogen-containing polyhydric alcohol initiator and at least one glycidyl ether having a carbon chain length of about 12 to about 18 aliphatic carbon atoms and wherein said glycidyl ether is present in the amount of about 1 to about 20 percent by weight based upon the total weight of said polyether thickener, wherein the amount of neodecanoic acid is about 0.3 to 5 percent by weight of said hydraulic fluid.

7. The method of claim 6 wherein said fluid includes at least one additive selected from the group consisting of phosphate esters or salts thereof selected from the group consisting of

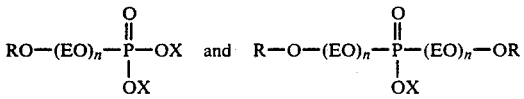

and mixtures thereof wherein ethylene oxide groups are represented by EO; R is selected from the group consisting of linear or branched chain alkyl groups wherein said alkyl groups have about 6 to 30 carbon atoms or alkylaryl groups wherein the alkyl groups have about 6 to 30 carbon atoms, and X is selected from the group consisting of hydrogen, an alkali or an alkaline earth metal, the residue of ammonia or an amine and mixtures thereof, and n is a number from 1 to 50;

an alkyldialkanolamide of the formula

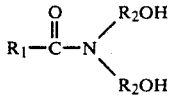

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

a defoamer;

an additional corrosion inhibitor;

water-soluble ethers or esters of ethoxylated $C_8$–$C_{36}$ aliphatic monohydric or polyhydric alcohols or acids;

sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

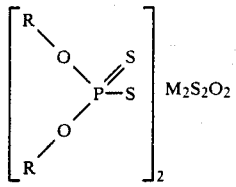

wherein M is molybdenum or antimony and R is organic and is selected from the group consisting of $C_3$–$C_{20}$ alkyl, aryl, alkylaryl radicals and mixtures thereof.

8. The hydraulic fluid of claim 7 wherein the amount of said additives is by weight about 0.01 to 3.0 percent phosphate ester, about 0.01 to 3.0 percent alkyl dialkanolamide, about 0.02 to 5.0 percent metal deactivator, about 0.01 to 2.0 percent defoamer, about 0.05 to 10 percent additional corrosion inhibitor, about 0.01 to 3 percent of said water-soluble ethers or esters; about 0.01 to 2 percent of said sulfur compound, and about 1 to 20 percent thickener.

9. The hydraulic fluid of claim 7 wherein said additional corrosion inhibitors include nitrates; nitrites; benzoates; amines, and imidazolines having the formula:

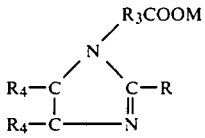

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

10. The hydraulic fluid of claim 9 wherein the amount by weight of said phosphate ester is about 0.01 to 3.0 percent, said alkyl dialkanolamide is about 0.01 to 3 percent, said metal deactivator is about 0.02 to 5.0 percent, said defoamer is about 0.02 to 2 percent, said imidazole is about 0.02 to 2 percent, said benzoate is about 0.02 to 2 percent, said amine is about 0.02 to 2 percent, said water-soluble ethers or esters are about 0.01 to 3 percent, said sulfur containing compound is about 0.01 to 2 percent, and said thickener is about 1 to 20 percent.

11. A method of improving anti-wear and corrosion inhibition properties of a hydraulic fluid comprising blending with said fluid at least abut 0.3 percent by weight of neodecanoic acid and at least one additive selected from the group consisting of phosphate esters or salts thereof selected from the group consisting of

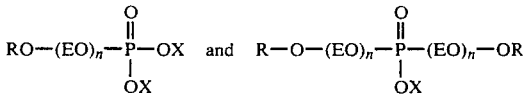

and mixtures thereof wherein ethylene oxide groups are represented by EO; R is selected from the group consisting of linear or branched chain alkyl groups wherein said alkyl groups have about 6 to 30 carbon atoms or alkylaryl groups wherein the alkyl groups have about 6 to 30 carbon atoms and X is selected from the group consisting of hydrogen, alkali or alkaline earth metal, the residue of ammonia or an amine and mixtures thereof, and n is a number from 1 to 50;

an alkyldialkanolamide of the formula

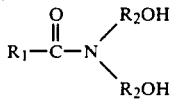

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

an additional corrosion inhibitor;

water-soluble ethers or esters of ethoxylated $C_8$–$C_{36}$ aliphatic monohydric or polyhydric alcohols or acids;

sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

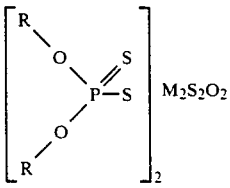

wherein M is molybdenum or antimony and R is organic and is selected from the group consisting of $C_3$–$C_{20}$ alkyl, aryl, alkylaryl radicals and mixtures thereof; and thickener.

12. The method of claim 11 wherein the amount of said additives in said hydraulic fluid is by weight about 0.01 to 3.0 percent phosphate ester, about 0.01 to 3.0 percent alkyl dialkanolamide, about 0.02 to 5.0 percent metal deactivator, about 0.01 to 2.0 percent defoamer, about 0.05 to 10 percent additional corrosion inhibitor, about 0.01 to 10 percent additional corrosion inhibitor, about 0.01 to 2 percent of said sulfur compound, and about 1 to 20 percent polyether thickener having a molecular weight of about 1000 to about 75,000 prepared by reacting ethylene oxide or ethylene oxide and at least one lower alkylene oxide having 3 to 4 carbon atoms with at least one active hydrogen-containing polyhydric alcohol initiator and at least one glycidyl ether having a carbon chain length of about 12 to 18 aliphatic carbon atoms and wherein said glycidyl ether is present in the amount of about 1 to about 20 percent by weight based upon the total weight of said polyether thickener.

13. The method of claim 11 wherein said additional corrosion inhibitors include nitrates; nitrites; benzoates; amines, and imidazolines having the formula:

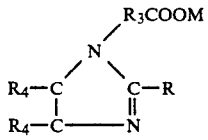

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

14. The method of claim 13 wherein the amount by weight of said phosphate ester is about 0.01 to 3.0 percent, said alkyl dialkanolamide is about 0.01 to 3 percent, said metal deactivator is about 0.02 to 5.0 percent, said defoamer is about 0.02 to 2 percent, said imidazoline is about 0.02 to 2 percent, said benzoate is about 0.02 to 2 percent, said amine is about 0.02 to 2 percent, said water-soluble ethers or esters are about 0.01 to 3 percent, said sulfur containing compound is abut 0.01 to 2 percent, and said thickener is about 1 to 20 percent.

* * * * *